US010354517B1

(12) United States Patent
King

(10) Patent No.: US 10,354,517 B1
(45) Date of Patent: Jul. 16, 2019

(54) METHOD OF PROVIDING A HUMAN-PERCEPTIBLE INDICATION OF ALARM MONITORING SYSTEM STATUS

(71) Applicant: The ADT Security Corporation, Boca Raton, FL (US)

(72) Inventor: Justin King, Knoxville, TN (US)

(73) Assignee: The ADT Security Corporation, Boca Raton, FL (US)

( * ) Notice: Subject to any disclaimer, the term of this patent is extended or adjusted under 35 U.S.C. 154(b) by 0 days.

(21) Appl. No.: 14/867,510

(22) Filed: Sep. 28, 2015

Related U.S. Application Data

(60) Provisional application No. 62/055,960, filed on Sep. 26, 2014.

(51) Int. Cl.
*G08B 29/18* (2006.01)

(52) U.S. Cl.
CPC ..... *G08B 29/185* (2013.01)

(58) Field of Classification Search
CPC ..... G08B 29/185; G08B 21/0415; G08B 13/1618; G08B 21/0469
USPC ..... 340/506
See application file for complete search history.

(56) References Cited

U.S. PATENT DOCUMENTS 7,864,983 B2 1/2011 Dronge
8,773,266 B2 * 7/2014 Starr ..... G08B 13/19667 340/572.1
8,937,539 B2 * 1/2015 Sharma ..... G08B 25/008 340/501
2005/0045710 A1 * 3/2005 Burke ..... G06Q 20/342 235/375
2008/0157964 A1 * 7/2008 Eskildsen ..... G08B 13/08 340/545.1
2009/0033505 A1 2/2009 Jones et al.
2011/0261195 A1 * 10/2011 Martin ..... G08B 13/19697 348/143
2011/0309929 A1 12/2011 Myers
2013/0257611 A1 * 10/2013 Lamb ..... G08B 13/02 340/501

FOREIGN PATENT DOCUMENTS

EP 2974963 A1 * 1/2016 ..... B64C 1/1423
EP 2974963 A1 * 1/2016 ..... B64C 1/1423

* cited by examiner

*Primary Examiner* — Steven Lim
*Assistant Examiner* — Mancil Littlejohn, Jr.
(74) *Attorney, Agent, or Firm* — Christopher & Weisberg, P.A

(57) ABSTRACT

A method and system for processing input data for an alarm monitoring system at a premises. Input data is received in proximity to an alarm triggering device. The input data is analyzed along with other data. An indication is generated based on the analysis as to whether actuation of an alarm triggering device could occur. Based on the indication and/or the analysis, a human-perceptible indication is initiated of the status of an alarm monitoring system at the premises, in proximity to a person and/or prior to actuating an alarm triggering device. An indication may be a color of light, change in light color, audio tone, change in audio tone, vibration, and/or change in vibration.

20 Claims, 8 Drawing Sheets

METHOD OF PROVIDING A HUMAN-PERCEPTIBLE INDICATION OF ALARM MONITORING SYSTEM STATUS

CROSS-REFERENCE TO RELATED APPLICATION

This application is related to and claims priority to U.S. Provisional Patent Application Ser. No. 62/055,960, filed Sep. 26, 2014, entitled METHOD OF PROVIDING A HUMAN-PERCEPTIBLE INDICATION OF ALARM MONITORING SYSTEM STATUS, the entirety of which is incorporated herein by reference.

STATEMENT REGARDING FEDERALLY SPONSORED RESEARCH OR DEVELOPMENT n/a

TECHNICAL FIELD

The present invention relates to a method and device for providing a human-perceptible indication of alarm system status.

BACKGROUND

Electronic alarm monitoring systems are useful in protecting a premises by detecting events prior to an occupant's detection of the event or in an occupant's absence. These systems may incorporate status indicators to communicate the state of the alarm system to a user. These systems are generally kept in an armed or disarmed state, with some variability to the degree of armed state (e.g., different modes, selecting zones, etc.). When a user is not aware of the current state of the system, the user may inadvertently trigger an alarm by activating one of the system's security sensors. This generates a false alarm event which may reduce the quality of the alarm monitoring service, place unnecessary burdens on first responders such as medical, fire and law enforcement officers, and may increase the cost of alarm monitoring to the home owner by generating fines, law suits, or the need for additional hardware to verify that the event is actually an alarm event.

In addition, a state indicator may alert a user to a transition between states or a fault with the system or component(s) of the system. Another possible result when a user is not aware of the current state includes failing to or delaying service for a fault condition. This could result in compromised security or unpredictable results from the system in response to an alarm event.

It is known in the art that providing human-perceptible status indicators may prevent a user from generating an unintended alarm event by alerting the user to the active state of the system (e.g., such as a buzzer sounding when entering a premises to remind the user to disarm the system). In addition, human-perceptible status indicators may notify the user that the system is not armed so that the user may arm the system to take advantage of the security provided by a system in an armed state. Systems may also alert a user to a transition between states. Further, human-perceptible status indicators may notify the user of an error or fault condition affecting the functionality of an alarm monitoring system which requires attention.

Methods of providing a human-perceptible status indication currently known in the art may be limited to displaying the state on a keypad, security panel, or portable user interface, or emitting an audio tone or vibration from one of these devices. These components of an electronic alarm monitoring system are necessary for inputting information, such as activation/deactivation codes, initial programming, linking components of the system to each other, or communicating between the alarm monitoring system and a monitoring center or other system. These components are not often the source for receiving input data that generates a false alarm event, or the most visible components to a user.

Methods for providing a sign of the status of an alarm monitoring system known in the art are not readily apparent to users in proximity to sensors that might trigger an alarm event. These alarm triggering devices may include door contacts, window contacts, motion detectors, or other event receivers that do not display any information about the alarm monitoring system status, serving only as input components for the system. In addition, fault indicators found on alarm system keypads or similar devices may not be noticed for some time as interacting directly with these devices may not be necessary on a frequent basis. Alternatively, they may be designed to generate indications when it is unknown if a user may observe the indication, such as repetitive annunciations from a siren which may impose additional operational costs or disturb pets at a premises while providing no utility as an indication to a system user.

SUMMARY

The invention relates to alarm monitoring systems and in particular to a method to provide a human-perceptible indication of alarm system status.

The invention further relates to input data for an event at a premises received by an alarm monitoring system, in proximity to an alarm triggering device. This input data may consist of data from one or more of a motion detector, a video camera, an audio sensor, a vibration sensor, a keypad, a pressure sensor, an infrared image sensor or similar device, a wireless network router or other communication device, a photosensor or similar device, a GPS device, active or passive assets tags, a "wearable" mobile device, a smart phone, etc.

In another aspect, the invention relates to input data that may be analyzed along with other data, in which other data may consist of a user setting, a system setting, the status of the alarm monitoring system, system usage data, mobile tag data, or identifying user information. This analysis may be based on the occurrence of an event and the state of the alarm monitoring system during the occurrence. A status of the alarm monitoring system may consist of one or more of armed-stay, armed-away, disarmed, transitional, and/or fault.

In yet another aspect, the invention relates to a sign of whether an action could actuate an alarm triggering device may be made based on analysis. An alarm triggering device may consist of one or more actuations of a contact sensor, a motion detector, a video camera, an audio sensor, an accelerometer, a vibration sensor, a pressure sensor, a temperature sensor, a fingerprint reader or other biometric device, an infrared image sensor or similar device, a vapor sensor, a wireless network router or other communication device, a photosensor or similar device, a tamper switch or other electromechanical actuator, a GPS device, active or passive assets tags, a personal emergency response system ("PERS") pendant, a "wearable" mobile device, a smart phone, etc.

In yet another aspect, the invention relates to initiating a human-perceptible indication of the status of an alarm monitoring system, in proximity to a person. This human-perceptible indication may be based on analysis and/or a sign of whether an action could actuate an alarm triggering device. Initiation of this human-perceptible indication of the status of an alarm monitoring system may be made prior to actuation of the alarm triggering device.

In yet another aspect, the invention relates to a human-perceptible indication may consist of one or more of a color of light, a change in light color, an audio tone, a change in an audio tone, a vibration, and/or a change in vibration. This human-perceptible indication may emanate from one or more wireless controller for the alarm monitoring system, user interface for the alarm monitoring system located proximate an entryway to the premises, and/or user interface for the alarm monitoring system located proximate a person.

Accordingly, a system is disclosed that may include a processor programmed to receive input data in proximity to an alarm triggering device, analyze input data in conjunction with other data, generate a sign of whether actuation of an alarm triggering device could occur, and initiate a human-perceptible indication. The system of this embodiment further includes an event receiver configured to receive input data from a motion detector, a video camera, an audio sensor, a vibration sensor, a keypad, a pressure sensor, an infrared image sensor or similar device, a wireless network router or other communication device, a photosensor or similar device, a GPS device, active or passive assets tags, a "wearable" mobile device, a smart phone, etc. The system of this embodiment yet further consisting of a source of other data which may consist of a database, an input component associated with the processor, or profile data. The system of this embodiment yet further consisting of an indicator which may consist of one or more wireless controller for the alarm monitoring system, user interface for the alarm monitoring system located proximate an entryway to the premises, user interface for the alarm monitoring system located proximate a person.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Provisional U.S. Patent Application Ser. No. 62/037,953, filed Aug. 15, 2014, entitled "METHOD FOR VERIFICATION OF AN ALARM EVENT USING OTHER DATA," is incorporated by reference herein.

The invention relates to alarm monitoring systems, and in particular to a method of providing a human-perceptible indication of alarm system status. Such alarm monitoring systems may be used within a boat, office suite, industrial building, residence and the like.

As used herein, relational terms, such as "first" and "second," "top" and "bottom," and the like, may be used solely to distinguish one entity or element from another entity or element without necessarily requiring or implying any physical or logical relationship or order between such entities or elements.

In embodiments described herein, the joining term, "in communication with" and the like, may be used to indicate electrical or data communication, which may be accomplished by physical contact, induction, electromagnetic radiation, radio signaling, infrared signaling or optical signaling, for example. One having ordinary skill in the art will appreciate that multiple components may interoperate and modifications and variations are possible of achieving the electrical and data communication.

For simplicity and ease of explanation, the invention will be described herein in connection with various embodiments thereof. Those skilled in the art will recognize, however, that the features and advantages of the invention may be implemented in a variety of configurations. It is to be understood, therefore, that the embodiments described herein are presented by way of illustration, not of limitation.

Alarm System and Supporting Infrastructure

Figure 1:
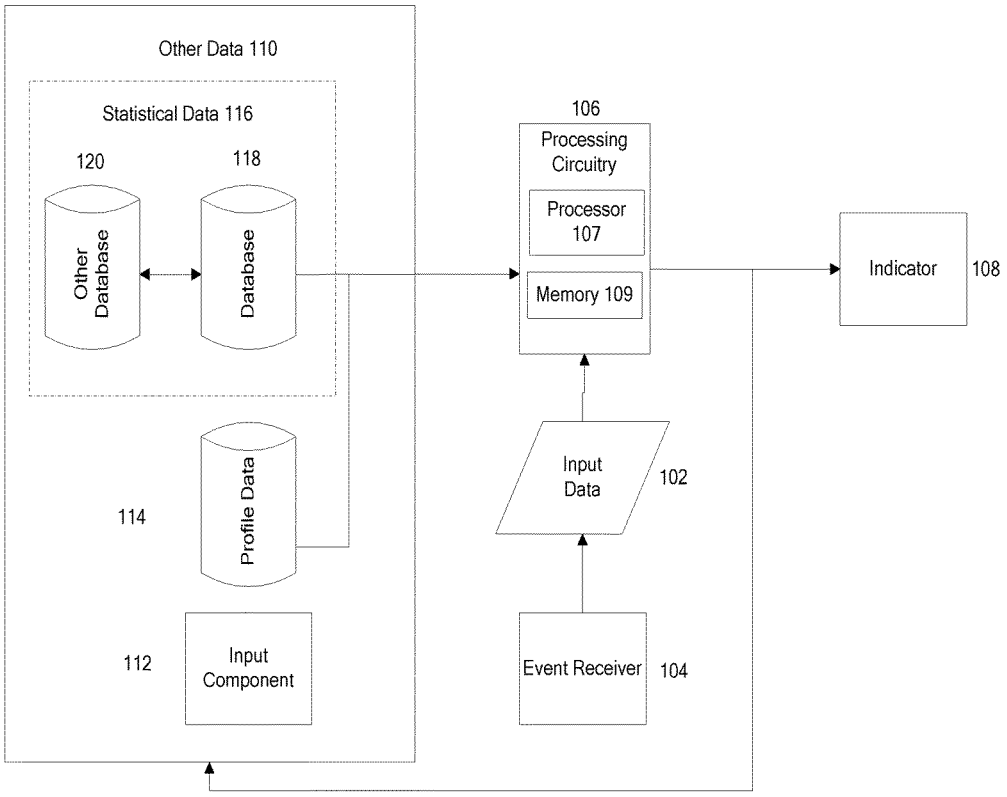
FIG. 1 is a block diagram of an illustrative embodiment of a system employing the invention.

The figures will be used to illustrate aspects of the invention. As shown in FIG. 1, in one embodiment an alarm monitoring system processing circuitry 106 may be programmed to receive input data 102 for an event at a premises generated by an event receiver 104. Event receiver 104 is not particularly limited as long as it is capable of providing data on an event being monitored by the system for an alarm condition, in proximity to an alarm triggering device. It may include, for example, any number of peripherals used with security, home automation, and/or telemedicine systems, such as a motion detector, a video camera, an audio sensor, a vibration sensor, a keypad, a pressure sensor, an infrared image sensor or similar device, a wireless network router or other communication device, a photosensor or similar device, a GPS device, active or passive asset tags (Bluetooth, RFID, and the like), "wearable" mobile devices and smart phones, etc. Internally, such devices contain electronic systems of varying sophistication involving hardware and in some cases a version of firmware or software, the operation of which is well known to those of ordinary skill in the art and will not be elaborated upon here. It should be understood that not all of such devices may be installed within a given system.

In one application, event receiver 104 is typically configured as part of an alarm monitoring system as an input/output device, in communication with processing circuitry 106 which may in turn communicate with a remote monitoring center, directly with a device belonging to the system's owner, or another device incorporated as part of the alarm monitoring system. Event receiver 104 may communicate with processing circuitry 106 via wired connection, proprietary wireless communication protocols and may also use Wi-Fi, all of which are known in the art. For example, portable control keypad may communicate with processing circuitry 106 via a ZigBee based communication link, e.g., network based on Institute of Electrical and Electronics Engineers (IEEE) 802.15.4 protocols, and/or Z-wave based communication link, or over the premises' local area network, e.g., network based on Institute of Electrical and Electronics Engineers (IEEE) 802.11 protocols. It is well known to those of ordinary skill in the art how these devices interact with the other components of an alarm monitoring system and that interaction will not be elaborated upon here. The invention is not limited in this regard so long as event receiver 104 operates in accordance with the functions as described herein, such as receiving input data 102, in proximity to an alarm triggering device. In one embodiment, processing circuitry 106 includes processor 107 and memory 109. In this embodiment, memory 109 may be volatile or not volatile memory that stores programmatic code executable by processor 107 to perform the functions described herein with reference to the processing circuitry 106. Processor 107 may be a traditional processor such as a central processing unit (CPU).

In addition to a traditional processor and memory, processing circuitry 106 may comprise integrated circuitry for processing and/or control, e.g., one or more processors and/or processor cores and/or FPGAs (Field Programmable Gate Array) and/or ASICs (Application Specific Integrated Circuitry). Processing circuitry 106 may comprise and/or be connected to and/or be adapted for accessing (e.g., writing to and/or reading from) memory 109, which may comprise any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory). Such memory 109 may be adapted to store code executable by control circuitry and/or other data, e.g., data pertaining to communication, e.g., configuration and/or address data of nodes, etc. Processing circuitry 106 may be configured to control any of the methods described herein and/or to cause such methods to be performed, e.g., by a device that includes processing circuitry 106. Corresponding instructions may be stored in the memory 109, which may be readable and/or readably connected to the processor 107. In other words, processing circuitry 106 may include a controller, which may comprise a microprocessor and/or microcontroller and/or FPGA (Field-Programmable Gate Array) device and/or ASIC (Application Specific Integrated Circuit) device. It may be considered that processing circuitry 106 includes or may be connected or connectable to memory, which may be adapted to be accessible for reading and/or writing by the controller and/or processing circuitry 106.

Processing circuitry 106 may be further programmed to receive other data 110. A source of other data 110 may include a database 118, an input component 112 associated with processing circuitry 106, or profile data 114. Database 118 may be configured to receive data transmitted from processing circuitry 106, transmit other data 110 to processing circuitry 106, receive data from a database 120, or transmit data to other database 120. Categories and examples of other data 110 are discussed in detail below.

Processing circuitry 106 may be configured to output information to a human-perceptible status indicator 108. Indicator 108 is not particularly limited as long as it is capable of providing a human-perceptible indication, in proximity to a person. Indicator 108 may also be capable of providing a human-perceptible indication prior to actuation of an alarm triggering device. It may include, for example, keypads, touchscreens, key fobs, tablet system controllers or other wireless controllers for an alarm monitoring system, for an alarm monitoring system, user interfaces for an alarm monitoring system located proximate an entryway to a premises or other area of a premises equipped with an alarm triggering device, user interfaces for an alarm monitoring system located proximate a sensor that may actuate an alarm triggering device, cell phones, pagers, or wireless communication devices, etc. Those of ordinary skill in the art will appreciate that communication with indicator 108 may be accomplished in ways similar, but not limited, to the examples cited above for communication with event receiver 104.

Figure 2A:
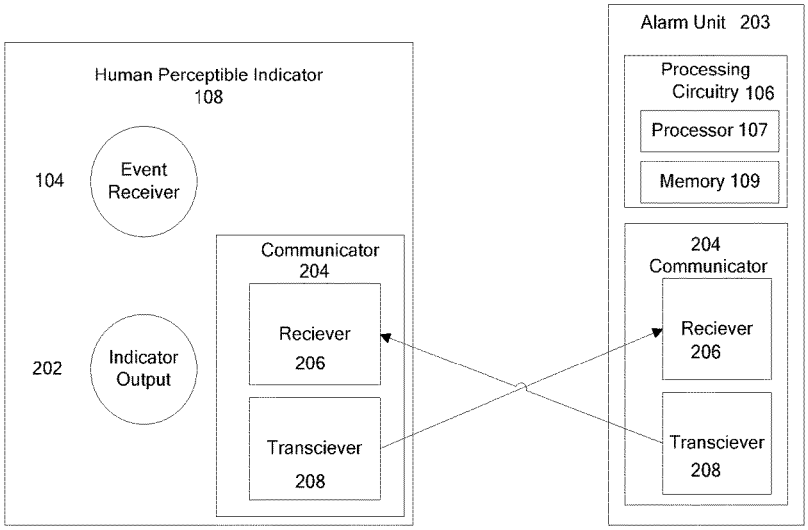
FIGS. 2(*a*)-(*b*) are block diagrams of illustrative embodiments the invention.
Figure 2B:
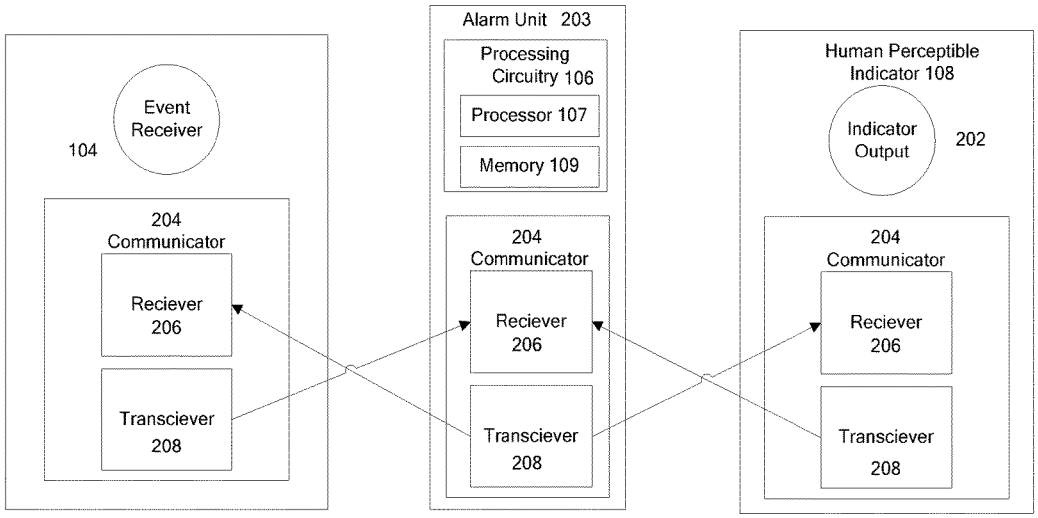

As shown in FIGS. 2(*a*) and 2(*b*), event receiver 104 may be incorporated in the same device as a human-perceptible status indicator 108 or they may be separate devices. Those of ordinary skill in the art will recognize the importance of placing indicator 108 in proximity to an alarm system component likely to trigger an alarm event. In some instances, this may be the same device as event receiver 104, for example a keypad next to an entryway. In other instances, for example when event receiver 104 may be a motion detector or video camera, placing indicator 108 within these device may not provide the most perceptible indication. In such instances, it may be more beneficial to place indicator 108 in a separate device, such as a door lock or keypad where it may be more likely to be observed than if indicator 108 is embedded in a motion detector or video camera as these devices may be remote, or even possibly housed in an inconspicuous design. Indicator 108 may also be a standalone component of an alarm system which communicates with alarm unit 203 via communicator 204, but has no functionality as an event receiver 104 or another component of a system, such as a user interface or alarm triggering device. For example, a previously established alarm monitoring system may have been developed and installed prior to the availability of the invention. In such instances, it may be advantageous to add a simplified embodiment of indicator 108 to near an existing alarm system component. This may be accomplished by, but is not limited to, placing an LED or audio annunciator housed with a radio and adhesive backing next to an existing keypad or door contact. Embodiments of human-perceptible indications capable of use in conjunction with the aforementioned status indicators 108 are discussed in more detail below.

In one embodiment, alarm unit 203 includes processing circuitry 106 and communicator 204. Communicator 204 can be any device or combination of elements suitable to facilitate communication with other devices. As shown in FIGS. 2(*a*) and 2(*b*), communicator 204 includes receiver 206 configured to receive communications from other devices, and transceiver 208 configured to transmit (or transmit and receive) communications from other devices. In other words, transceiver 208 can take the form of only a transmitter or can both transmit and receive. In the latter case where transceiver 208 is configured to both transmit and receive communications, receiver 206 may be omitted.

Those of ordinary skill in the art will appreciate that all of the aforementioned components: alarm unit 203, communicator 204, receiver 206, transceiver 208, processing circuitry 106, event receiver 104, databases 118 and 120, input component 112 and indicator 108 are not particularly limited in construction as long as they operate in accordance with the invention and functions described herein. They may incorporate any of a number of commonly known hardware and software technologies, such as relational databases, Linux and other operating systems, flash memory and other forms of storage memory, single or multi-core microprocessors such as ARM processors or others, digital signal processors (DSPs), embedded controllers, etc.; one or more parts of which may be located at the premises or at a remote location such as a monitoring center, a cloud-based solution, the system owner's mobile device, or elsewhere.

Method for Providing a Human-Perceptible Indication of an Armed State

Figure 3:
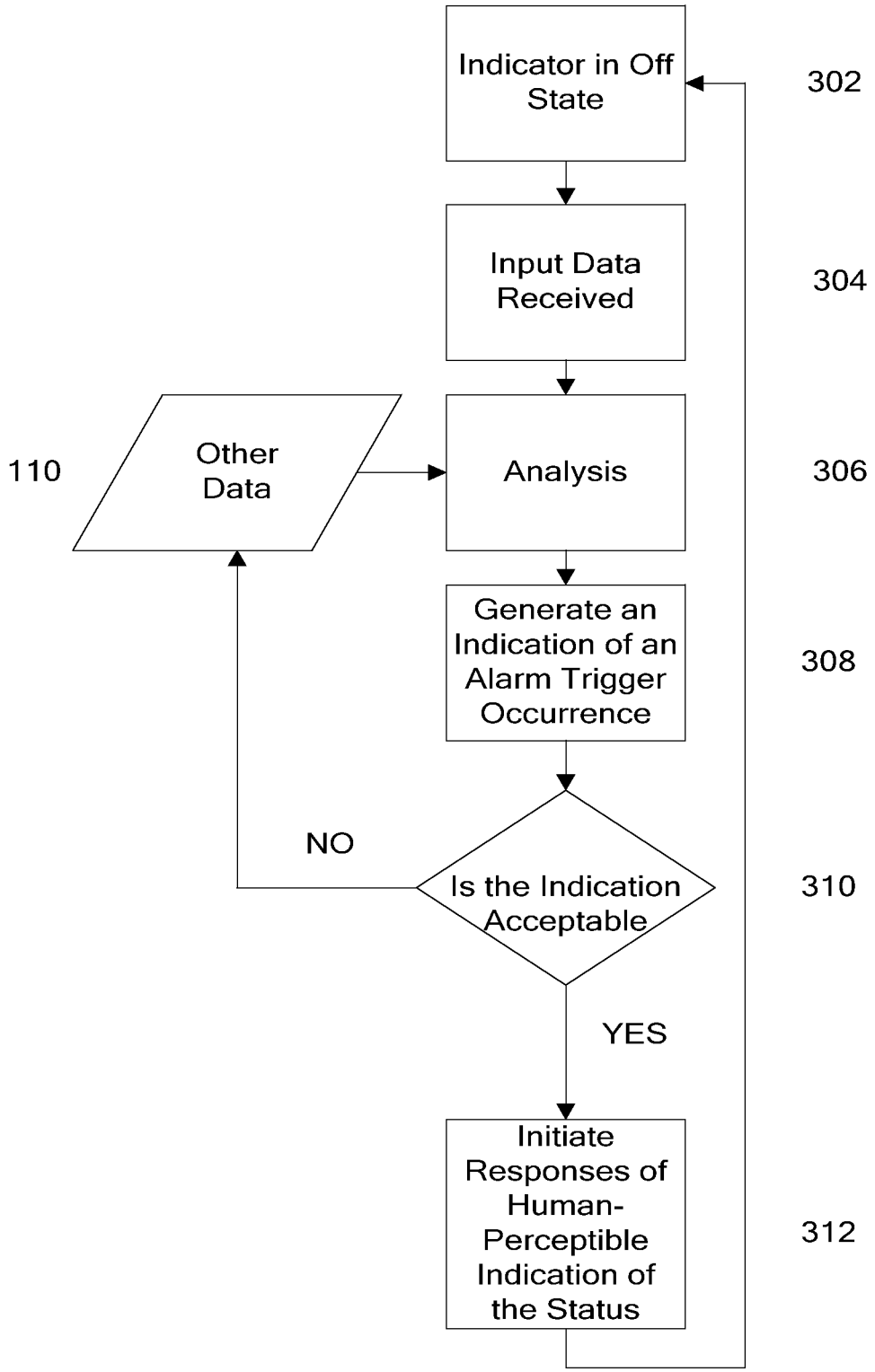
FIG. 3 is a flowchart of an illustrative embodiment of a method employing the invention.

As shown in FIG. 3, in one embodiment there is a method for providing a human-perceptible indication which may begin with indicator 108 in the off state (302). When input data 102 is received (304) by event receiver 104, analysis (306) of input data 102 in conjunction with other data 110 may occur.

Other data 110 may include a user setting, a system setting, a status of the alarm monitoring system, system usage data, mobile tag data, or identifying user information. A user setting may be manual input intended to customize the standard system operation. For example, a user setting may disable all or part of the functionality included in the patent indefinitely, for set periods of time, or for particular components of the system. In further illustration of this example, a system setting may include disabling the human-perceptible indicator emanating from components of the system labeled "Zone 2 and Zone 4", or may disable the reception of input data 102 for a subset of event receivers 104 based on the type of component or based on the location on the premises. For example, a setting may specify that no alarm events may be triggered by motion detectors.

A system setting may consist of numeric value or grade corresponding to a desirable degree of sensitivity for the analysis 306. In another example, a system setting may be a time frame within which a certain number of events must occur in order for analysis (306) not to dismiss the events as isolated or non-verifiable non-alarm events. In yet another example, a system setting may also specify the sensitivity of event receiver 104. For example, it may be a decibel level which actuates an audio receiver, a quantity of lumens which actuates a photo receiver, a distance within a motion detector may be actuated by motion, or other quantifiable metrics associated with various types of event receiver 104. In yet another example, a system setting may specify a duration of event receiver 104 actuation, or a degree of variation detected by event receiver 104. For example, a system setting may only allow analysis (306) to include input data 102 for actuations of a door contact longer than 750 milliseconds, a differentiation of 10% above ambient temperature detected by a thermal sensor, or an increase of 20 dB detected by an audio sensor.

A status of an alarm monitoring system may be a setting input by an occupant of the premises, set as a result of analysis (306), or specified in profile data 114. A status refers to the general level of detection and response desired of a system. These settings may often be, but are not limited to, "armed-stay", "armed-away", "disarmed", transitional, or fault, the meaning, function and operation of each being well known to those of ordinary skill in the art and ware not elaborated upon here.

System usage data may consist of historic data including previous instances of input data 102, other data 110 present at the same time as input data 102, actuation of alarm triggering devices in the presence of input data 102 and other data 110, and other information about the usage of the alarm monitoring system. For example, data may include a series of actuations of a particular door contact at approximately the same time each day. Data may also include a series of alarm state transitions coinciding with this time. Combining such data with input data 102 may help avoid a false alarm in a case where a door contact actuation occurs, but a state transition does not occur at this time by initiating a human-perceptible indication in proximity of that particular door contact.

Mobile tag data may be part of profile data 114 or data from database 120. Such data may correspond to wireless transmitter using RFID, Bluetooth and the like to communicate with the alarm system. Such tag data may include unique identifiers associated with a person, pet, wireless device, appliance, or other device containing a mobile tag. Tag data may be used in analysis (306) in a variety of ways to improve determination of whether an action could actuate an alarm triggering device, e.g., in block 308. For example, input data 102 received by a motion detector may be analyzed (306) in conjunction with tag data in profile data 114 known to be associated with an occupant's pet. The method may determine that an action is unlikely to actuate an alarm triggering device in this instance, if a system is in the "armed-stay" state. However, if tag data in profile data 114 known to be associated with an occupant is used for analysis (306) in conjunction with input data 104 from an audio sensor, the method may determine that an action, such as opening a door equipped with a door contact, may actuate an alarm triggering device.

Identifying user information may include video data, unique wireless communication data, biometric data, or other information that could serve to differentiate one person from another. For example, other data 110 may consist of an identifier contained in a cell phone proximate to an event receiver 104 on the premises that is either a subset of identifying user information or not. In another example, other data 110 consisting of a key fob associated with the system may be received by an event receiver 104 consisting of a proximity access reader on the premises. In yet another example, other input data 104 may be the output from facial recognition software with an associated database and video analysis data received by an event receiver 104 consisting of a video camera. In yet more examples, identifying user information may be a height and weight combination, a quantity or threshold of thermal radiation, or an infrared profile that may be able to distinguish one person from another person or one person from a non-human, such as a pet or feral animal on the premises. Such information may be used in determining what, if any indication to initiate (312).

Such identifying user information may be stored as a set of profile data 114 in database 118 associated with the system or consist of a subset of "big data" stored in some remote database 120 accessible by the system. For example, the profile data may include a set of height and weight combinations to distinguish the occupants of the premises from non-occupants, or a massive array of facial profiles may be stored in a remote database and serve as other data 110 for use in conjunction with input data 102 received by an event receiver 104 consisting of video analysis data. Other profile data may include, but is not limited to information relevant to the occupants of the premises, pets kept at the premises, smart phone data, 3rd party personal data, "Melissa" data, structural details of the premises, or geographic information relevant to the premises.

Analysis (306) may be based on the state of the alarm monitoring system during the occurrence of an event at the premises. For example, analysis (306) may be dependent on an armed state prior to commencement. Those of ordinary skill in the art will recognize that there may be no advantage to initiating a human-perceptible indication (312) that the system is disarmed to a person on the exterior of a structure at a premises. Such an indication may entice possible intruders who would otherwise be deterred through visual observation of alarm system components at the premises to follow through with an intrusion once provided with a sign 312 that the system is currently disarmed.

In one embodiment, the analysis (306) may include a recursive or reiterative procedure, as shown in FIG. 3, to generate an acceptable sign (308) of whether an action could actuate an alarm triggering device. Those of ordinary skill in the art will recognize that a single execution of the method disclosed may not generate a sign (308) that reduces the chance of a false alarm below a desired threshold, but that providing at least a portion of the generated sign 308 back to the source of other data 110 for another iteration of the method may improve the quality of the indication provided in block 308 and further reduce the chance of a false alarm. Those of ordinary skill in the art will also recognize the advantage of ensuring that the indication is acceptable (310) prior to initiating a human-perceptible indication (312).

In one aspect of this embodiment, at least a portion of the indication provided in block 308 may be used in a feedback loop either before or after producing an acceptable indication (310). Those of ordinary skill in the art will appreciate that even if the indication is acceptable for this instance of input data 102, transmission to the source of other data 110 for use with a future event at the premises may be advantageous and improve the quality of future indications 308. As shown in FIG. 3, the portion of the indication generated in block 308 sent through the feedback loop may differ depending on if the indication is acceptable (310).

In another aspect of this embodiment, iterations of analysis (306) may repeat recursively until an acceptable indication is generated (310), at which time the method may initiate a response (312).

The analysis 306 may be used to create insight data that incorporates "scoring" related to the probability that an action may actuate an alarm triggering device. Scoring may be a combination of different types of personal data, or combinations of scoring for different types of data—for example, and omnibus score (e.g., a "life score") that is a combination of a significant number of the different scores tracked by the system. For example, input data 102 from a video camera and a pressure sensor may be used in conjunction with system usage data that contains information on how often an alarm triggering device is actuated when input data 102 is received from both a video camera and a pressure sensor.

Analysis (306) may take user defined (or predefined) criteria and apply them against the input data 102 and other data 110 to create this score. These criteria may include comparing against similar scoring across a pool of other users, or against goals specifically set by the user as to the "level" of security that they would like to achieve.

The analysis 306 may also use a credibility threshold to calculate if the indication is acceptable 310. For example, if a score of "80" results from the previous example, it may be compared to a credibility threshold of "90". This will result in a generated indication in block 308 that is not reliable enough and therefore the indication is not acceptable (310), and the analysis 306 will seek additional other data 110 until a sore meeting or exceeding the threshold is achieved.

In another aspect of this embodiment, analysis (306) may incorporate other techniques such as A/B testing, association rule learning, classification, cluster analysis, crowd sourcing, data fusion and integration, ensemble learning, genetic algorithms, machine learning, natural language processing, neural networks, pattern recognition, anomaly detection, predictive modeling, regression, sentiment analysis, signal processing, supervised and unsupervised learning, simulation, time series analysis and visualization. Multidimensional big data can also be represented as tensors, which can be more efficiently handled by tensor-based computation, such as multi-linear subspace learning.

Additional technologies also being used with big data that may be used in the invention include massively parallel-processing (MPP) databases, search-based applications, data-mining grids, distributed file systems, distributed databases, cloud based infrastructure (applications, storage and computing resources) and the Internet. This can be accomplished, of course, in various combinations of architectures, single or multiple processors, single or multiple server, single or multiple database, etc.

In yet another aspect of this embodiment, an alarm triggering device may include one or more contact sensors, a glass break detector, a motion detector, a video camera, an audio sensor, an accelerometer, a vibration sensor, a keypad, a pressure sensor, an infrared image sensor or similar device, a wireless network router or other communication device, a photosensor or similar device, a tamper switch or other electromechanical actuator, a GPS device, active or passive asset tags (Bluetooth, RFID, and the like), "wearable" mobile devices and smart phones, etc. It should be understood that not all of such devices may be installed within a given system. The operation of such devices as alarm triggering devices is well known to those of ordinary skill in the art and shall not be further elaborated upon here.

When an alarm triggering device is actuated, the alarm monitoring system may transmit an alarm signal to one or more notification device, such as horns and/or strobes, for example. Heating, ventilation and air-conditioning (HVAC) controls, thermostats, remotely controllable appliance switches, wall switches, receptacles, and other home automation devices may also be used. The alarm monitoring system may also update other data 110 or transmit to a first responder, a monitoring center, or an occupant of the premises or an occupant's contact.

In yet another aspect of this embodiment, a human-perceptible indication of the status of an alarm monitoring system at a premises may be initiated (312) when there is a sign 308 that an action may actuate an alarm triggering device. Those of ordinary skill in the art will recognize the actuation of an alarm triggering device based upon an unintended action of a system owner or occupant of a premises may result in undesirable, and costly, outcomes such as false alarms accompanied by fines, and possibly discourage a system owner from arming a system in the future. Such discouragement may result in underutilization of an alarm system, exposing a system owner or occupant of a premises to unnecessary future risk. Those of ordinary skill in the art will further recognize providing a human-perceptible indicator, as described in the invention, may prevent a false alarm, thus enhancing the value of the system.

This human-perceptible indication may consist of one or more of a color of light, a change in light color, an audio tone, a change in an audio tone, a vibration, a change in vibration, a phone call, a text message, or an email. For example, one or more human-perceptible indications may involve a change in LED's or other light emitting device's illumination or color status. The source of light may go from an un-illuminated state to a state of illumination, or it may change from one color to another color. For example, an LED may change from inactive to "green" to represent that a system is unarmed, or it may change from inactive to "red" to represent that the system is armed. In another example, an LED near an alarm triggering device may alternate between the off and on states or from one color to another to represent that the system is in an armed state and interaction with the alarm triggering device may cause an alarm event.

In yet another aspect of this embodiment, a human-perceptible indication may be in the form of an audio tone or series of tones designed to alert the user of the alarm system status. For example, no tones or a single tone may indicate that the system is unarmed while a series of tones may indicate that the system is in an armed state and the user is likely to trigger an alarm event. In another example, an infrequent tone indicating that the system is in an armed state may change to a more rapid series of tones to alert a person on the premises that interaction with the alarm triggering device may cause an alarm event.

In yet another aspect of this embodiment, a human-perceptible indication may be in the form of a vibration or change in vibration to make sound or create sensation when contacting an alarm triggering device. For example, no vibration or a single vibration may indicate that the system is unarmed while a series of vibrations may indicate that the system is in an armed state and the user is likely to trigger an alarm event. In another example, an infrequent vibration indicating that the system is in an armed state may change to a more rapid series of vibrations to alert a person on the premises that interaction with the alarm triggering device may cause an alarm event.

In yet another aspect of this embodiment, a human-perceptible indication may be in the form of an electronic communication sent to a user's cellular device. This communication may be a text message, phone call or email conveying the state of the alarm system, and possibly a sign of by which sensor and at which premises the event information was received. For example, if analysis 306 using input data 102 and other data 110 yields a sign 308 that a person on the premises may actuate an alarm triggering device, and this person may be identified through alarm monitoring system profile data, a call or text message to that person's cell phone may be made to indicate the status of the alarm monitoring system since the person is likely to be carrying their cell phone. Such indication may deter the cause of a false alarm by providing a user knowledge of the state of an alarm system while not relaying any information to an unknown person, who may not be included in alarm monitoring system profile data.

Figure 4:
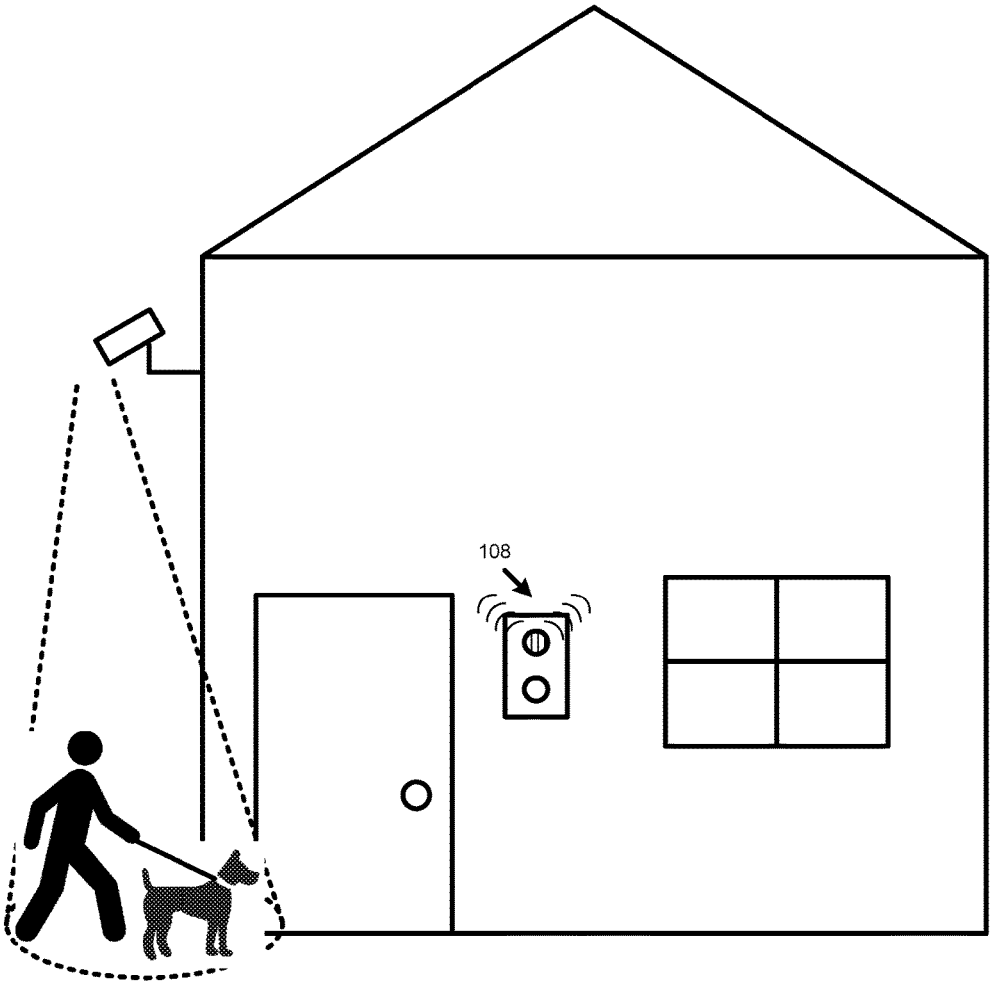
FIG. 4 is an illustration of an embodiment of the invention.

Those of ordinary skill in the art will recognize the advantage of the embodiments mentioned above over the industry standard indicator of an LCD or touchscreen incorporated within a keypad component of an alarm system for the increased perceptibility of these embodiments as well as the expanded placement options at a premises. For example, a keypad may often be located within a structure and be unable to offer a perceptible indicator to a person on the exterior of the structure. As shown in FIG. 4, indicator 108 in the form of an LED, audio or vibration indicator located on the exterior of the structure near an entry to the structure may provide a better indication of the alarm system status.

Figure 5:
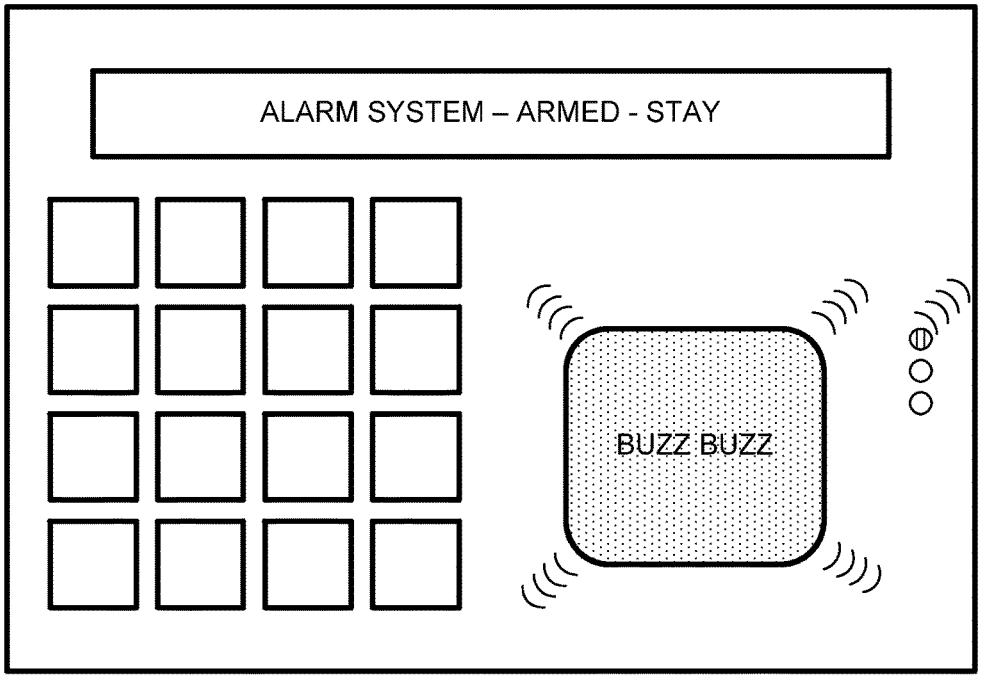
FIG. 5 is an illustration of an embodiment of the invention.
Figure 6:
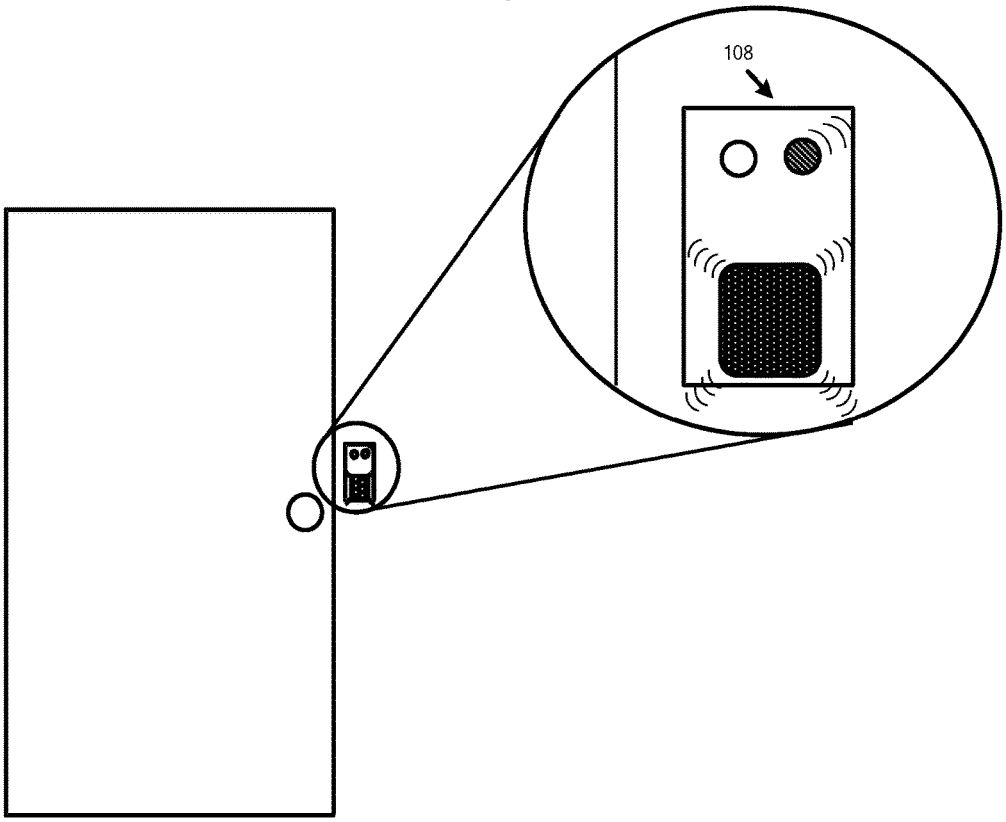
FIG. 6 is an illustration of an embodiment of the invention.

As shown in FIG. 5, in another embodiment, incorporating a human-perceptible indication in the form of a series of tones, vibrations, or LED state changes emanating from an interface for the alarm monitoring system, such as a keypad, may provide the person with the notice necessary for them to enter a code and avoid a false alarm. In another example, a human-perceptible indication in the form of an LED emitting a color of light may emanate from a key fob for the alarm monitoring system, alerting a person on the premises that they must enter a code in a keypad upon entry in order to avoid a false alarm. In yet another example, as shown in FIG. 6, an indicator 108 in the form of a tone or LED actuation may emanate from a user interface located proximate an entryway to the premises such as a door handle when an indication is generated (308) that an action may actuate an alarm triggering device such as a door contact.

In yet an another example, an LED or chime may be incorporated in to a window contact to notify a person inside a structure on the premises that the alarm monitoring system is in an armed-stay state and must be disarmed prior to opening a window in order to avoid an action that may actuate an alarm triggering device. A person detected approaching a motion detector near a window contact may cause analysis (306) to generate an indication (308) that the window contact may be actuated. Initiating a human-perceptible indication (312) in the form of an LED or chime emanating from a window contact may prevent actuation of such a device, and generation of a false alarm.

Method for Providing a Human-Perceptible Indication of a Fault State

In addition to reducing false alarms, a human-perceptible indicator may also be useful in providing information to the operability of an alarm monitoring system. Those of ordinary skill in the art will recognize that a method for providing such indications may be similar to the method described above for use in providing a human-perceptible indication of an alarm monitoring system's state. Providing a sign of a system fault condition in proximity to the likely location of a system user by initiating a sign in proximity to an alarm triggering device actuation or probability of an alarm triggering device actuation my increase the utility of such indication over methods currently known in the art.

Figure 7:
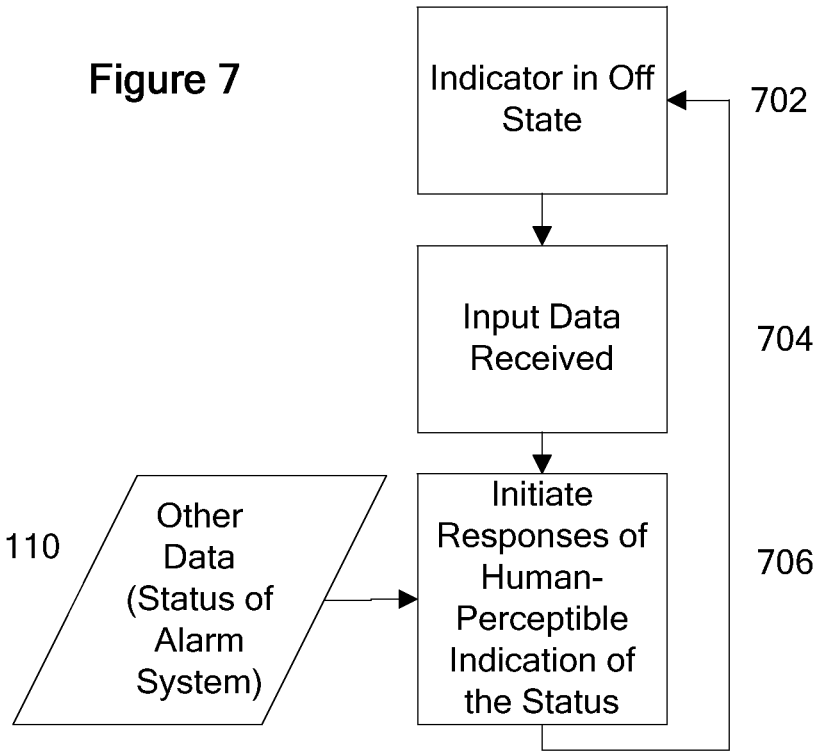
FIG. 7 is a flowchart of an illustrative embodiment of a method employing the invention.

As shown in FIG. 7, in one embodiment there is a method for providing a human-perceptible indication that may begin with indicator 108 in the off state (702). When input data 102 is received (704) by event receiver 104, processing circuitry 106 may initiate responses of human-perceptible indications of the alarm monitoring system status (706), based upon other data 110 including the status of the alarm monitoring system. Those of ordinary skill in the art may recognize that analysis similar to that described above may provide benefits such as updating statistical data. Such analysis may not be necessary to initiate a sign of a fault condition due to the differences in purpose between that indication and a sign designed to prevent false alarms, such as those described above.

Figure 8:
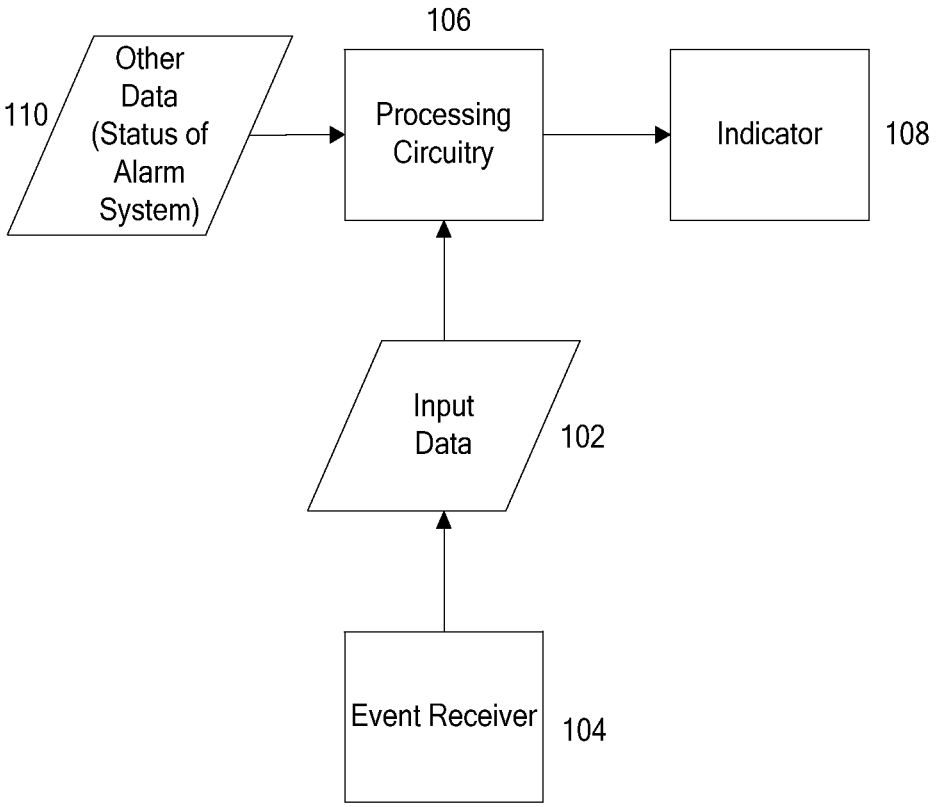
FIG. 8 is a block diagram of an illustrative embodiment of a system employing the invention.

As shown in FIG. 8, in one embodiment processing circuitry 106 may be programmed to receive input data 102 for an event at a premises generated by event receiver 104. Event receiver 104 is not particularly limited as long as it is capable of providing data on an event being monitored by the system for an alarm condition. It may include, for example, any number of peripherals used with security, home automation, and/or telemedicine systems, such as a contact sensor, a motion detector, a video camera, an audio sensor, an accelerometer, a vibration sensor, a pressure sensor, a temperature sensor, a fingerprint reader or other biometric device, an infrared image sensor or similar device, a vapor sensor, a wireless network router or other communication device, a photosensor or similar device, a tamper switch or other electromechanical actuator, a GPS device, active or passive assets tags, a personal emergency response system ("PERS") pendant, a "wearable" mobile device, smart phone, etc.

Processing circuitry 106 may be configured to output information to a human-perceptible status indicator 108. Indicator 108 is not particularly limited as long as it is capable of providing a human-perceptible indication, in proximity to an alarm triggering device. It may include, for example, key fobs, tablet system controllers, or other wireless controllers for an alarm monitoring system, user interfaces for an alarm monitoring system located proximate an entryway to a premises or other area of a premises equipped with an alarm triggering device, and/or user interfaces for an alarm monitoring system located proximate a sensor that may actuate an alarm triggering device. Those of ordinary skill in the art will appreciate that communication with indicator 108 may be accomplished in ways similar, but not limited, to the examples cited above for communication with event receiver 104.

Internally, such devices contain electronic systems of varying sophistication involving hardware and in some cases a version of firmware or software, the operation of which is well known to those of ordinary skill in the art and will not be elaborated upon here. It should be understood that not all of such devices may be installed within a given system. Those of ordinary skill in the art will appreciate that event receiver 104 may be of a type capable of detecting an event attributable to human presence, such as a door contact. Those of ordinary skill in the art will further recognize that while a door contact may not have been useful in the method of the invention useful for preventing a false alarm, it may be of use along with a wider range of sensor types for providing a sign of an alarm monitoring system fault condition.

In one embodiment of the invention, a system user may approach an exit to a premises which is equipped with event receiver 104, such as a door contact. Opening the door may cause an event which leads to the door contact generating input data which may be received by processing circuitry 106 (704). The alarm system may be functioning properly. In response, processing circuitry 106 may initiate a sign of the absence of a fault condition (706), such as a green light from indicator 108 consisting of an LED incorporated in a door lock, or it may be desirable to initiate no indication as no action may be required when a system is functioning properly.

Alternatively, an alarm monitoring system such as the one described above may have a fault condition such as a low battery in a component, loss of communication with a monitoring center, loss of communication between alarm monitoring system components, or any other condition which may cause the system to operate incorrectly. In such an alternative, when a system user such as the one described above approaches a doorway with a door contact, indicator 108 may indicate to the user that attention is required by emitting a series of blinking yellow light or vibrating a door lock upon actuation of the door contact.

As will be appreciated by one of skill in the art, the concepts described herein may be embodied as a method, data processing system, and/or computer program product. Accordingly, the concepts described herein may take the form of an entirely hardware embodiment, an entirely software embodiment or an embodiment combining software and hardware aspects all generally referred to herein as a "circuit" or "module." Furthermore, the disclosure may take the form of a computer program product on a tangible computer usable storage medium having computer program code embodied in the medium that can be executed by a computer. Any suitable tangible computer readable medium may be utilized including hard disks, CD-ROMs, electronic storage devices, optical storage devices, or magnetic storage devices.

Some embodiments are described herein with reference to flowchart illustrations and/or block diagrams of methods, systems and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory or storage medium that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Computer program code for carrying out operations of the concepts described herein may be written in an object oriented programming language such as Java® or C++. However, the computer program code for carrying out operations of the disclosure may also be written in conventional procedural programming languages, such as the "C" programming language. The program code may execute entirely on the user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider).

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope of the invention, which is limited only by the following claims.

What is claimed is:

1. A method for indicating an armed status of an alarm monitoring system at a premises, the method comprising:

receiving an indication of motion of a person that is approaching an alarm triggering device for the alarm monitoring system, the alarm triggering device configured to trigger an alarm event;

analyzing the indication along with other data related to the motion of the person as the person approaches the alarm triggering device, the other data including at least one of a user setting and alarm monitoring system usage data; and initiating, based on the analysis of the indication and the other data, a human-perceptible indication of the armed status of the alarm monitoring system on a device that is proximate the alarm triggering device without triggering an alarm of the alarm monitoring system in response to the analysis.

2. The method of claim 1 further comprising initiating, based on the analysis of the indication and the other data, the human-perceptible indication of the status of the alarm monitoring system in proximity to the person prior to actuation of the alarm triggering device.

3. The method of claim 1 further comprising:

generating, based on the analysis of the indication and the other data, a sign of whether actuation of the alarm triggering device could occur; and initiating, based on the sign, the human-perceptible indication of the status of the alarm monitoring system in proximity to the person.

4. The method of claim 3 further comprising initiating, based on the sign, the human-perceptible indication of the status of the alarm monitoring system prior to actuation of the alarm triggering device.

5. The method of claim 1, wherein the indication comprises data from at least one selected from the group consisting of a motion detector, a video camera, an audio sensor, a vibration sensor, a keypad, a pressure sensor, an infrared image sensor, a wireless network router, a photosensor, a GPS device, active asset tag, passive active tag, a wearable mobile device, and a smart phone.

6. The method of claim 1, wherein the user setting includes an indication to disable reception of input data received from at least one event receiver.

7. The method of claim 1, wherein the alarm triggering device comprises at least one selected from the group consisting of a contact sensor, a motion detector, a video camera, an audio sensor, an accelerometer, a vibration sensor, a pressure sensor, a temperature sensor, a biometric device, an infrared image sensor, a vapor sensor, a wireless network router, a photosensor, a tamper switch, electromechanical actuator, a global positioning system ("GPS") device, active asset tag, passive asset tag, a personal emergency response system ("PERS") pendant, a wearable mobile device, and a smart phone.

8. The method of claim 1, wherein the status of the alarm monitoring system comprises at least one selected from the group consisting of armed-stay and armed-away.

9. The method of claim 1, wherein the human-perceptible indication comprises at least one selected from the group consisting of a color of light, a change in light color, an audio tone, a change in an audio tone, a vibration, and a change in vibration.

10. The method of claim 1, wherein the human-perceptible indication emanates from at least one selected from the group consisting of a wireless controller for the alarm monitoring system, a user interface for the alarm monitoring system located proximate an entryway to the premises, and a user interface for the alarm monitoring system located proximate the person.

11. The method of claim 1, wherein the alarm monitoring system usage data includes a result of a previous analysis of different input data and identifying user information.

12. A system configured to initiate a human-perceptible indication of an armed status of an alarm monitoring system comprising:

a device in proximity to an alarm triggering device, the device including:

processing circuitry, the processing circuitry including a processor and a memory, the memory containing instructions that, when executed by the processor, configure the processor to:

receive an indication of motion of a person that is approaching an alarm triggering device for the alarm monitoring system, the alarm triggering device configured to trigger an alarm event;

analyze the indication along with other data related to the motion of the person as the person approaches the alarm triggering device, the other data including at least one of a user setting and alarm monitoring system usage data; and initiate, based on the analysis of the indication and the other data, a human-perceptible indication of the armed status of the alarm monitoring system without triggering an alarm of the alarm monitoring system in response to the analysis;

an event receiver configured to generate the indication; and an indicator configured to emit the human-perceptible indication of the status of the alarm monitoring system.

13. The system of claim 12, wherein the alarm triggering device comprises at least one selected from the group consisting of a contact sensor, a motion detector, a video camera, an audio sensor, an accelerometer, a vibration sensor, a pressure sensor, a temperature sensor, a biometric device, an infrared image sensor, a vapor sensor, a wireless network router, a photosensor, a tamper switch, electromechanical actuator, a global positioning system ("GPS") device, active asset tag, passive asset tag, a personal emergency response system ("PERS") pendant, a wearable mobile device, and a smart phone.

14. The system of claim 12, wherein the user setting includes an indication to disable reception of input data received from at least one event receiver.

15. The system of claim 12, wherein the event receiver comprises at least one selected from the group consisting of a motion detector, a video camera, an audio sensor, a vibration sensor, a keypad, a pressure sensor, an infrared image sensor, a wireless network router, a photosensor, a GPS device, active asset tag, passive asset tag, a wearable mobile device, and a smart phone.

16. The system of claim 12, wherein the status of the alarm monitoring system comprises at least one selected from the group consisting of armed-stay, and armed-away.

17. The system of claim 12, wherein the indicator comprises at least one selected from the group consisting of a source of light, a speaker, siren, and a source of vibration.

18. The system of claim 12, wherein the human perceptible indication comprises at least one selected from the group consisting of a color of light, a change in light color, an audio tone, a change in an audio tone, a vibration, and a change in vibration.

19. The system of claim 12, wherein the alarm monitoring system usage data include a result of a previous analysis of different input data and identifying user information.

20. A method for indicating an armed status of an alarm monitoring system at a premises, the method comprising:

receiving an indication of motion of a person that is approaching an alarm triggering device for the alarm monitoring system, the alarm triggering device configured to trigger an alarm event;

analyzing the indication along with other data related to the motion of the person as the person approaches the alarm triggering device, the other data including alarm monitoring system usage data containing identifying user information; and initiating, based on the analysis of the indication and the other data, a human-perceptible indication of the armed status of the alarm monitoring system on a device that is proximate the alarm triggering device without triggering an alarm of the alarm monitoring system in response to the analysis.

* * * * *